US010321228B2

(12) United States Patent
Smith et al.

(10) Patent No.: US 10,321,228 B2
(45) Date of Patent: Jun. 11, 2019

(54) SOUND CAPTURE METHOD AND APPARATUS

(71) Applicant: SAM SYSTEMS 2012 LIMITED, Colyton, Devon (GB)

(72) Inventors: Richard John Smith, Lyme Regis Dorset (GB); Anthony Herbert Walker, Lyme Regis Dorset (GB)

(73) Assignees: SAM SYSTEMS 2012 LIMITED, Colyton, Devon (GB); Anthony Herbert Walker, Lyme Regis, Dorset (GB)

( * ) Notice: Subject to any disclaimer, the term of this patent is extended or adjusted under 35 U.S.C. 154(b) by 68 days.

(21) Appl. No.: 15/302,353

(22) PCT Filed: Apr. 13, 2015

(86) PCT No.: PCT/GB2015/051113

§ 371 (c)(1),
(2) Date: Oct. 6, 2016

(87) PCT Pub. No.: WO2015/155552

PCT Pub. Date: Oct. 15, 2015

(65) Prior Publication Data

US 2017/0034617 A1 Feb. 2, 2017

(30) Foreign Application Priority Data

Apr. 11, 2014 (GB) ..... 1406556.9

(51) Int. Cl.
*H04R 1/02* (2006.01)
*H04R 1/34* (2006.01)
(Continued)

(52) U.S. Cl.
CPC ..... *H04R 1/342* (2013.01); *H04R 1/026* (2013.01); *H04R 1/08* (2013.01); *H04R 1/222* (2013.01); *H04R 2201/025* (2013.01)

(58) Field of Classification Search
CPC ..... H04R 1/342; H04R 1/026; H04R 1/08; H04R 1/222; H04R 1/34; H04R 1/40;
(Continued)

(56) References Cited

U.S. PATENT DOCUMENTS 4,437,189 A * 3/1984 Newman ..... H04R 27/00 381/118
4,438,189 A 3/1984 Geissler et al.
(Continued)

FOREIGN PATENT DOCUMENTS

EP 1 33 896 A1 9/2001
JP 2004/343668 A 12/2004
(Continued)

OTHER PUBLICATIONS

International Search Report, dated Jul. 8, 2015, from corresponding PCT application.

*Primary Examiner* — Amir H Etesam
(74) *Attorney, Agent, or Firm* — Young & Thompson

(57) ABSTRACT

A method and apparatus to capture sound produced by an audio device including a sound source and a loudspeaker. The apparatus includes a microphone support coupleable to the loudspeaker and a microphone mounted on the support, the microphone being locatable within a volume surrounded by a diaphragm of the loudspeaker and being arranged to detect pressure waves caused by movement of a vibrating element of the loudspeaker. Aspects and embodiments provide an element to capture sounds from a loudspeaker in a manner which is compact and which ameliorates disadvantages associated with alternative arrangements since a greater core sound to ambient sound ratio may be captured.

20 Claims, 6 Drawing Sheets

(51) Int. Cl.
*H04R 1/08* (2006.01)
*H04R 1/22* (2006.01)

(58) Field of Classification Search
CPC ..... H04R 2201/025; H04R 3/002; H04R 2420/07; H04R 2420/09; H04R 2430/01; H04R 1/083; H04R 11/04; H04R 21/021
See application file for complete search history.

(56) References Cited

U.S. PATENT DOCUMENTS

| | | | | |
|---|---|---|---|---|
| 4,570,746 | A * | 2/1986 | Das | H04R 1/086 181/242 |
| 7,092,535 | B1 | 8/2006 | Pedersen et al. | |
| 8,929,580 | B2 | 1/2015 | Ohashi et al. | |
| 2002/0168078 | A1* | 11/2002 | Kuerti | H04R 3/002 381/361 |
| 2002/0168079 | A1 | 11/2002 | Kuerti et al. | |
| 2006/0153401 | A1 | 7/2006 | Pedersen et al. | |
| 2006/0262946 | A1* | 11/2006 | Yang | H04R 5/027 381/175 |
| 2009/0180656 | A1 | 7/2009 | Benditt | |
| 2012/0014551 | A1 | 1/2012 | Ohashi et al. | |

FOREIGN PATENT DOCUMENTS

| | | | |
|---|---|---|---|
| WO | 0021331 | A1 | 4/2000 |
| WO | 0035247 | A1 | 6/2000 |
| WO | 2010/095380 | A1 | 8/2010 |

* cited by examiner

SOUND CAPTURE METHOD AND APPARATUS

FIELD OF THE INVENTION

The present invention relates to apparatus for capturing sound produced by an audio device, especially from a loudspeaker, and a method of capturing sound produced by an audio device.

BACKGROUND

Sound capture devices are known. In particular, sound capture devices often comprise microphones. Conventional microphones, even of the highest quality, may suffer from a number of issues particularly when deployed to capture the sound produced by a sound source.

Some issues particularly arise when a conventional microphone is used to capture sound emanating from, for example, a particular musical instrument which may be being played for recording purposes. It is difficult to selectively pick up only the sound source without also picking up unintended sounds from, for example, ambient noise. Furthermore, if a particular sound source is being played in conjunction with other sound sources, a microphone may be operable to pick up unintended sounds from the other sound sources, which may give rise to unwanted feedback noise.

Typical miking techniques for studio recordings and live performances comprises providing at least one microphone on a stand in front of a loudspeaker which produces a sound based on a feed from a given sound source.

In the case of sound sources provided by electric instruments, such as electric guitars, the direct feed between the instrument and am amplifier is referred to as a dry signal. The sound source itself does not produce sound until the dry signal is passed to an amplifier and loudspeaker. The dry signal may pick up characteristics from both the amplifier and the loudspeaker, so that in relation to electric instruments, the sound heard by a listener is a composite created from the combination of the dry signal and the amplifier and loudspeaker. To capture the sound created by such a composite instrument, there are a number of existing instrument miking techniques.

A typical miking technique for studio recordings or live performances comprises the positioning of one or more microphones on a stand in front of a loudspeaker associated with that instrument. Such a technique has known shortcomings.

Firstly, a single loudspeaker is typically directional and can display different frequency characteristics at different angles and distances. The loudspeaker itself is an acoustic instrument. The desired sound often develops at some distance away from the speaker. Some approaches use close miking of an individual speaker. At short distance it is possible to achieve minimal ambient pick-up and high direct sound pick-up. However, such positioning may then not pick up the rounded or blended sound that a loudspeaker is meant to produce at distance. Conversely, placing a microphone remote from the loudspeaker results in increased ambient noise capture. Any open air microphone captures other unwanted environmental sounds in addition to desired capture of the source sound.

Providing a microphone in front of each instrument-associated loudspeaker also brings an operational and logistical burden. Microphones must be handled with care since they contain delicate electronic components. Provision of a large number of microphones and associated stands results in a large amount of time being used for setting up and taking down equipment.

In the prior art US2002/0168079A and US2009/0180656A propose microphone supports which attach the support strut to the speaker cabinet itself to help maintain the relative alignment of microphone and speaker. In U.S. Pat. No. 4,438,189 the support is a mounting bar extending diametrically across the mouth of the speaker cone, the microphone body or housing projecting axially back into the cone from a centre region of the support bar. This works poorly in practice because in most speakers there is insufficient room in front of the speaker diaphragm for this, and even when it will fit, the high intensity and proportionately large diaphragm movement towards and away from the microphone prevents good sound pickup.

It is desired to provide an alternative or improved apparatus and method to capture sound.

SUMMARY

Aspects of our invention are set out in the claims.

In one aspect we provide apparatus to capture sound produced by an audio device comprising a sound source and a loudspeaker; said apparatus comprising: a microphone support coupleable to the loudspeaker and a microphone mounted on the support, the microphone being locatable within a volume surrounded by a diaphragm of the loudspeaker and arranged to detect pressure waves caused by a movement of a vibrating element of the loudspeaker.

The first aspect recognizes that a loudspeaker typically comprises a vibrating element which is coupled to a conical diaphragm, which amplifies the movement of the vibrating element to produce pressure waves. The first aspect recognizes that it is possible to collect pressure waves from within the volume surrounded by the conical diaphragm of a loudspeaker; those pressure waves being representative of the sound produced by the loudspeaker outside the speaker cabinet. Locating a microphone within the volume surrounded by a diaphragm of the loudspeaker itself allows for mitigation of pickup of ambient noise outside a speaker cabinet. Although it may be thought that placing a microphone within the volume surrounded by a conical diaphragm of a loudspeaker might subject the microphone to point source frequencies rather than a blended sound, it has been found that appropriate placement of a microphone within the volume enclosed by a loudspeaker diaphragm may allow for capture of a sufficiently blended sound. In some arrangements, for example, a sufficiently blended sound may be obtained if the microphone is mounted away from the centre and/or edges of the diaphragm, thus substantially avoiding pickup of harsh treble frequencies emanating from the centre of a loudspeaker cone, and low frequency, or distorted, vibrations emanating from the edge of the loudspeaker cone.

The apparatus may comprise a beam diffuser, e.g. arranged to project into the volume surrounded by the loudspeaker diaphragm. Accordingly, it is possible to assist with capture of a blended sound from within a volume enclosed or surrounded by a loudspeaker diaphragm by appropriately arranging a beam diffuser within that volume.

A beam diffuser is something known in itself. It may comprise a diffuser element and a support which is usually installed between the outer edge of a loudspeaker and a baffle board to which the loudspeaker may be secured. A beam diffuser can be located symmetrically within the volume surrounded by a loudspeaker diaphragm, and arranged to "block" a region in the centre of that volume.

Such an arrangement may prevent point-source high-frequencies, or "treble" frequencies, from beaming directly from a loudspeaker cabinet. Appropriately shaped beam diffusers may operate such that they redirect or diffuse high frequencies back into the volume enclosed by the loudspeaker diaphragm so that they are blended with lower frequency vibrations and so that they radiate from a loudspeaker in a generally wider beam pattern. A beam diffuser may be substantially symmetrical and substantially centrally located within the volume surrounded by a loudspeaker diaphragm, such that high frequencies are diffused evenly in all directions. Often it is circular in outline. Provision of a beam diffuser as part of an apparatus according to the first aspect may help to ensure that a microphone placed within the volume enclosed by the diaphragm of the loudspeaker is operable to receive a blend of all frequencies being reproduced by the loudspeaker.

The beam diffuser is preferably arranged substantially concentrically with a loudspeaker cone. Accordingly, such an arrangement may help to diffuse high frequencies in all directions evenly within the volume enclosed by the loudspeaker diaphragm.

Preferably the beam diffuser comprises a substantially dome-shaped element or other diffuser element which is convex towards the speaker. Thus the beam diffuser may comprise a domed beam diffuser. In some embodiments, the dome may be substantially curved. In some embodiments, the dome may be substantially hemispherical. In some arrangements, the dome is hollow. Or, the diffuser may have inner and outer elements which form a hollow housing.

The microphone may be mounted adjacent, in or behind (outwardly of) the beam diffuser. In one embodiment, the microphone is mounted within the beam diffuser. The microphone may be arranged to lie substantially wholly within the beam diffuser. Accordingly, some arrangements may provide a microphone located within the beam diffuser. Such an arrangement may ensure that a blend of all frequencies emanating from a loudspeaker is captured by the microphone. In one embodiment, the microphone may be enclosed within a beam diffuser.

Where the microphone and the beam diffuser are arranged to lie substantially within or at the front of the volume enclosed by the loudspeaker diaphragm, a small microphone may be provided. Locating the beam diffuser and the microphone within the volume surrounded by a loudspeaker diaphragm can ensure that little, if any, extra space is required for the sound capture apparatus.

The microphone preferably comprises a dynamic microphone. Alternatively however a condenser microphone may be used. Such microphones may comprise miniature microphones or microphone capsules (transducers). Accordingly, space required by the apparatus may be minimized. It will be appreciated that a condenser microphone may require a pre-amplifier in order to operate, whereas a dynamic microphone is unlikely to require such a pre-amplifier and is typically more robust than a corresponding condenser microphone.

Preferably the support spans the loudspeaker diaphragm. In one embodiment, the support may comprise a span element, such as a crossbar, which spans the entire diameter of the loudspeaker diaphragm. Accordingly, a symmetrical arrangement may minimize distortion to pressure waves within the volume enclosed by the loudspeaker diaphragm caused by the presence of the apparatus of the first aspect. The support, may, however, comprise an arm which extends across into the volume enclosed by the loudspeaker diaphragm. This may be in a cantilevered manner. In preferred embodiments the support comprises an annular member and a plurality of spokes, or one or more span elements, extending radially inward from the annular member. A segment of an annular member may be used. An annular member or segment thereof can fit around and against the annular periphery of a loudspeaker. In some embodiments, the apparatus may further comprise a gasket, locatable between the microphone support and the loudspeaker. Accordingly, undesirable vibration or rattle induced between the speaker and the apparatus of the first aspect may be minimized.

The microphone may be adjustably mountable on the support. Accordingly, microphone placement within the volume enclosed by the loudspeaker diaphragm may be easily adjusted. The adjustable mount may comprise, for example, a slot arrangement along which a microphone mounting may be moved, and a fastening device, allowing the microphone to be fixed in place in position within the slot.

Additionally or alternatively the device or apparatus may comprise plural microphones, mounted at different positions and/or alignments relative to the speaker, e.g. on the same support or on respective supports. A switch and/or alternative selectable connectors may be provided enabling selection of different ones, or different combinations, of the plural microphones to control the sound picked up by the apparatus.

In many cases the microphone has a directional sensitivity pattern, such as a cardioid pattern, having a pattern axis with a forward direction. Desirably it is mounted such that when the support is coupled to the loudspeaker, the pattern axis is inclined away from the speaker axis, e.g. by an angle from 45° to 90°, or from 70° to 88°. Especially in conjunction with the diffuser which mixes the frequencies away from the centre of the cone, this may firstly avoid overloading the microphone and secondly direct it towards a region part way out along the speaker radius where mixed frequencies more representative of the desired sound may prevail.

Apparatus according to the first aspect may comprise a retrofit kit, fixable to an existing loudspeaker. Or, apparatus according to the first aspect may be integrally manufactured as part of a loudspeaker.

A second aspect provides a method of capturing sound produced by an audio device comprising a sound source and a loudspeaker, the method comprising:

coupling a microphone support to the loudspeaker; mounting a microphone on the support; locating the microphone within a volume surrounded by a diaphragm of the loudspeaker; and arranging the microphone to detect pressure waves caused by movement of a vibrating element of the loudspeaker.

In one embodiment, the method may comprise providing a beam diffuser and arranging it to project into the volume enclosed by the loudspeaker diaphragm.

The method may comprise arranging the beam diffuser substantially concentrically with the cone.

The beam diffuser may comprise a substantially dome-shaped element.

The method may comprise mounting the microphone adjacent the beam diffuser.

The method may comprise mounting the microphone within the beam diffuser.

The method may comprise arranging the microphone to lie substantially wholly within the beam diffuser.

The method may comprise arranging the microphone and the beam diffuser to lie substantially within the volume enclosed by the loudspeaker diaphragm.

The microphone may be a dynamic microphone.

The support may be mounted to span the loudspeaker diameter.

The microphone may be adjustably mountable on the support.

A third aspect provides a loudspeaker or loudspeaker cabinet including sound capture apparatus according to the first aspect.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present invention will now be described with reference to the accompanying drawings, in which.

DESCRIPTION OF THE EMBODIMENTS

Figure 1:
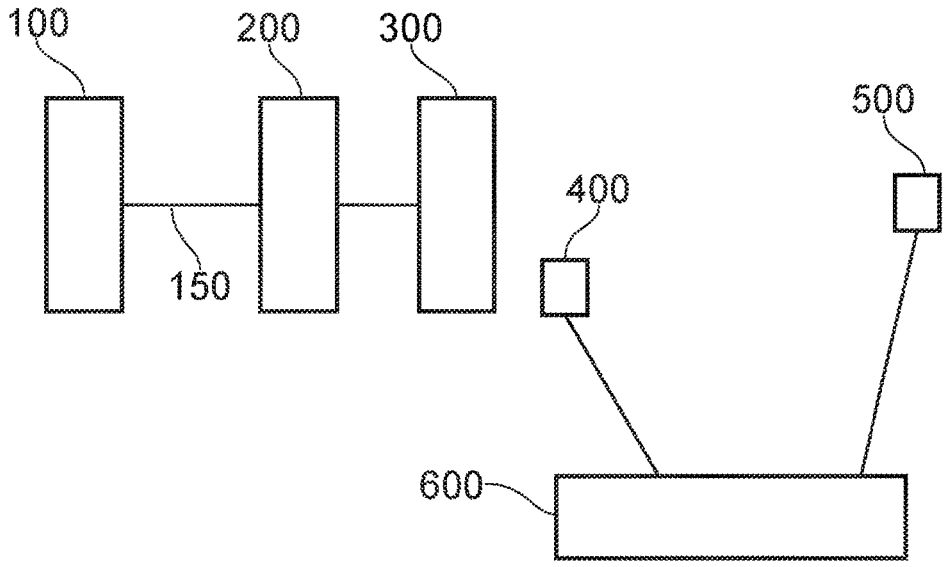
FIG. 1 illustrates schematically some components of a general sound capture arrangement.

FIG. 1 illustrates schematically some components of a known sound capture arrangement. The sound capture arrangement shown in FIG. 1 comprises a sound source 100, an amplifier 200 and a loudspeaker 300. A close range microphone 400 is provided substantially adjacent to loudspeaker 300 and the signal from that microphone is fed to a sound desk 600. Optionally, a long range microphone 500 may also be provided to capture sound produced by a loudspeaker 300. A long range microphone 500 is likely to pick up a signal which is subject to significant ambient noise. In the arrangement shown, the sound source 100 may comprise an electric instrument, for example, an electric guitar or keyboard, which itself does not generate sound and instead produces a dry electrical signal 150 which is fed to the amplifier 200 and from there to the loudspeaker 300. The operational characteristics of the amplifier 200 and the loudspeaker 300 influence the sound of the instrument being played by a musician. It is the aim of the closely placed microphone 400 to capture the sound of that instrument which is then passed to a sound desk or recording desk 600.

In typical performance or recording scenarios, sounds produced by different instruments are taken separately to a mixing console 600 so that their individual sounds can be combined, balanced and then transmitted or recorded as appropriate. The combined sound of a number of instruments can be blended and balanced appropriately and that blend can be fed to a public address system or used as a source for recording.

Most speakers are voiced to project sound to a considerable distance. Such "long throw" loudspeakers are such that a representative sound of an instrument is only produced some distance from a loudspeaker. Typically, in the immediate vicinity of a loudspeaker, treble elements of sound, which have relatively high frequencies and emanate from the centre of a loudspeaker cone, are somewhat harsh. In order for a microphone to capture a representative sound of an instrument, it has traditionally been thought that the microphone needs to be placed some distance from a loudspeaker to capture that rounded sound. In live performance scenarios, such distant microphones may be subject to the pick-up of large amounts of ambient noise and, as a consequence, microphones are typically placed close to a loudspeaker face. In known arrangements, a vocal or specialist microphone can be suspended from the top of a loudspeaker and located such that it is placed in front of the speaker face. According to one alternative typical arrangement, close microphones are mounted on stands placed on the floor in front of the amplified loudspeaker. Such stands require significant manpower in relation to system set up and tear down, require space in front of a loudspeaker and may be prone to accidental movement.

It has been found that closely placed microphones can be affected by pressure waves created by a cone of the loudspeaker and as a result, closely placed microphones used to collect instrument sound are often set an angle to the front face of a loudspeaker to reduce pressure wave effects. However, being so positioned can be the cause of feedback and/or squeal since the operation of the microphone may be such that it also captures ambient sound from other sound sources.

Figure 2A:
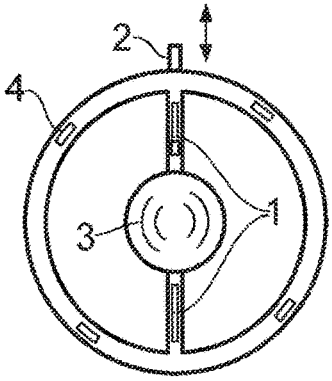
FIGS. 2*a* to 2*c* illustrate schematically sound capture apparatus in a first embodiment of our proposals.
Figure 2B:
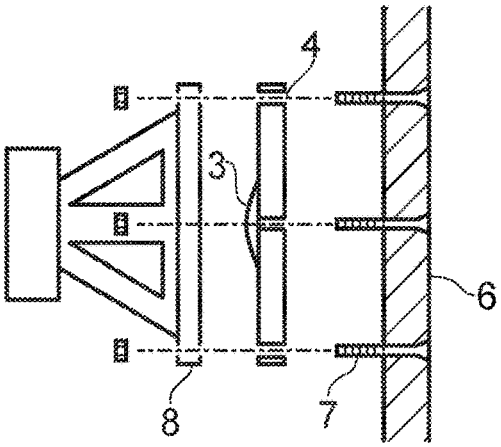
Figure 2C:
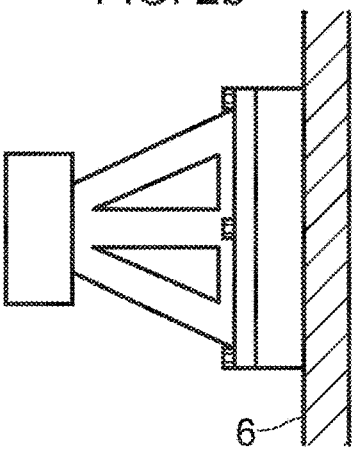

FIG. 2*a* illustrates schematically a plan view of apparatus for sound capture according to one arrangement. FIG. 2*b* is a schematic exploded side elevation of the apparatus of FIG. 2*a* in position on a loudspeaker; and FIG. 2*c* illustrates schematically the apparatus of FIG. 2*a* when fastened in position in a loudspeaker.

The apparatus shown in FIG. 2*a* comprises a generally annular support which includes a span element upon which a beam diffuser and a microphone may be mounted.

FIG. 2*b* is an exploded side view of the apparatus of FIG. 2*a* being located between the edge of a loudspeaker 8 and a sound board 6 of a loudspeaker device e.g. cabinet. FIG. 2*c* is a schematic side view of the apparatus of FIG. 2*a* when secured in position on a loudspeaker.

The apparatus of FIG. 2*a* is operable to capture sound produced by an audio device comprising a sound source and the loudspeaker 8. The apparatus of FIG. 2*a* comprises a microphone support 4 coupleable to the loudspeaker and a microphone 1 mounted on the support, that microphone being locatable within a volume enclosed by a diaphragm of the loudspeaker and the microphone being arranged to detect pressure waves caused by movement of a vibrating element of the loudspeaker.

In general, arrangements may use one or more miniature microphones positioned immediately in front of and/or projecting into a volume enclosed by a loudspeaker diaphragm. It will be understood that the sound capture apparatus shown in FIG. 2*a* and in general as proposed herein may be located within the volume enclosed by the diaphragm of the loudspeaker and thus can be substantially hidden behind a loudspeaker cabinet grille or cloth.

According to some arrangements, one or more microphones may be provided with an appropriate pressure wave detection frequency range. The microphone of some arrangements may be chosen to have physical dimensions small enough to be substantially unaffected by sound pressure when located in close proximity to the loudspeaker cone. The placement of the microphone within the volume enclosed by the loudspeaker diaphragm may be such that the pick-up of erroneous ambient sounds can be substantially eliminated.

In the arrangement shown in FIG. 2*a*, one or more miniature microphones, such as electret condenser microphone capsules, are mounted on a bar fixed across the diameter of the front face of a loudspeaker. The miniature microphone capsules can be positioned between the perimeter of a circle defined by the outer edge of the loudspeaker diaphragm and the centre of that circle at various positions along a bar. In the arrangement shown, the fixed bar comprises one or more slots upon which a miniature microphone capsule may be fixed. It will be understood that the microphone capsule can be fixed in position at one of many selectable locations along the slot.

According to some arrangements, miniature microphone capsules may be connected to, and powered by, a remote pre-amplifier (not shown). A pre-amplifier can, according to some arrangements, be conveniently and accessibly mounted within the loudspeaker cabinet. According to some arrangements, a direct connection to a mixing console is provided. That direct connection from the microphone to the mixing console may comprise a suitable cable or coupling routed from the microphone to the pre-amplifier and then to the mixing console. According to some arrangements, a connection to a remote mixing console can be made by an appropriate wireless radio link. According to some arrangements, a mechanism may be provided at the pre-amplifier to alter signal strength (gain) sent to a mixing console.

In the arrangement shown in FIG. 2*a*, the apparatus further comprises a beam diffuser 3 locatable towards the centre of the loudspeaker diaphragm. The beam diffuser comprises a substantially domed element which projects or is directed into the volume surrounded by the loudspeaker diaphragm. Provision of such a beam diffuser helps to reduce harsh treble elements of sound typically experienced at close proximity to a loudspeaker. The beam diffuser 3 can help to ensure that the sound collected by a miniature microphone located within the volume surrounded by the loudspeaker diaphragm is not compromised and, in particular may help to ensure that the sound captured by the microphone placed within the volume enclosed by the diaphragm of the loudspeaker is not overly harsh. Provision of a beam diffuser has the effect of blending higher frequencies into an overall sound produced by the loudspeaker cone. According to some arrangements, the miniature microphone may be located directly behind the beam diffuser.

Figure 3A:
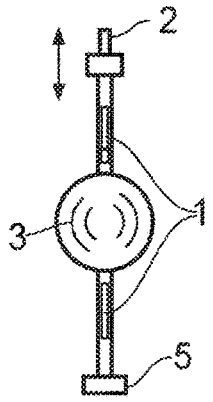
FIGS. 3*a* to 3*c* illustrate schematically sound capture apparatus in a second embodiment of our proposals.

FIG. 3*a* illustrates sound capture apparatus according to an alternative arrangement. According to the arrangement shown in FIG. 3*a*, the microphone support comprises a single beam which spans the diameter of the loudspeaker diaphragm and upon which a beam diffuser is also provided.

Figure 3B:
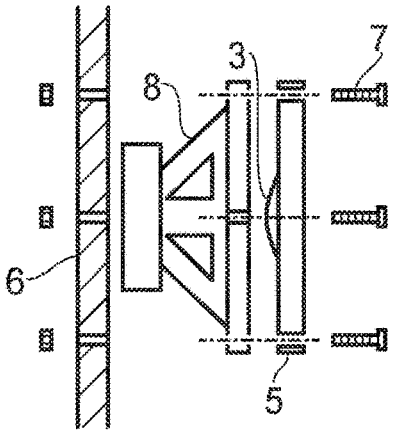
Figure 3C:
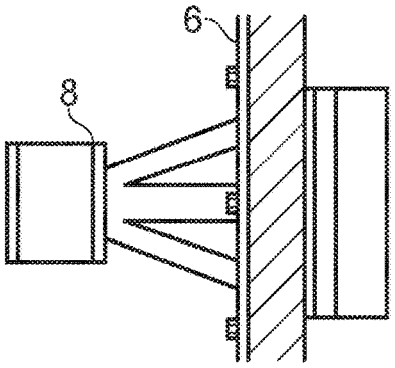

In FIGS. 2 and 3, the following reference numerals are used to denote technical features of significance to the sound capture arrangement. The preferred position and support for a microphone is indicated with reference numeral 1. A tab 2 is provided to allow movement or adjustment of the position of the microphone. A domed sound diffuser 3 is provided. In one arrangement, a circular gasket-like frame 4 is provided. That gasket may be affixed in position around the perimeter of a loudspeaker. A bar support 5 upon which a microphone can be mounted is supplied in both illustrated arrangements. A sound board 6 is shown, as are speaker fixing bolts 7.

In the arrangements shown in FIGS. 2 and 3, the sound capture apparatus is held in position on an audio device. In particular, the location of the apparatus in relation to a loudspeaker cone can be fixed since the apparatus can be sandwiched between an edge of a volume enclosed by a speaker cone and, for example, the sound board at the point of installation of speaker into speaker cabinet by using speaker fixing bolts 7. According to another arrangement, the location of the apparatus in relation to the loudspeaker cone is fixed with regard to the face of the speaker by independent clips and/or a ring secured in position by use of the speaker fixing bolts. According to such an arrangement the back face of the speaker edge may also be secured to the speaker sound board using the speaker fixing bolts.

Figure 4:
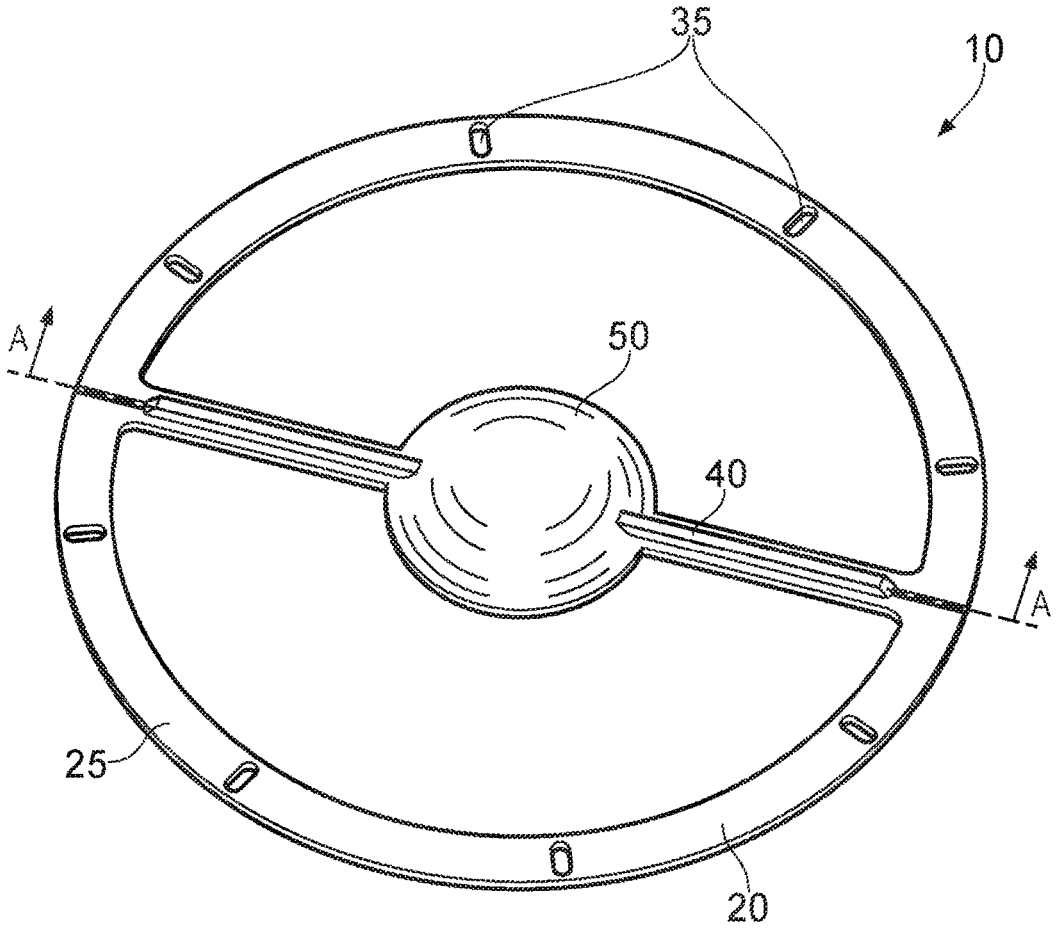
FIGS. 4 to 6 illustrate schematically sound capture apparatus in a third embodiment of our proposals.
Figure 5:
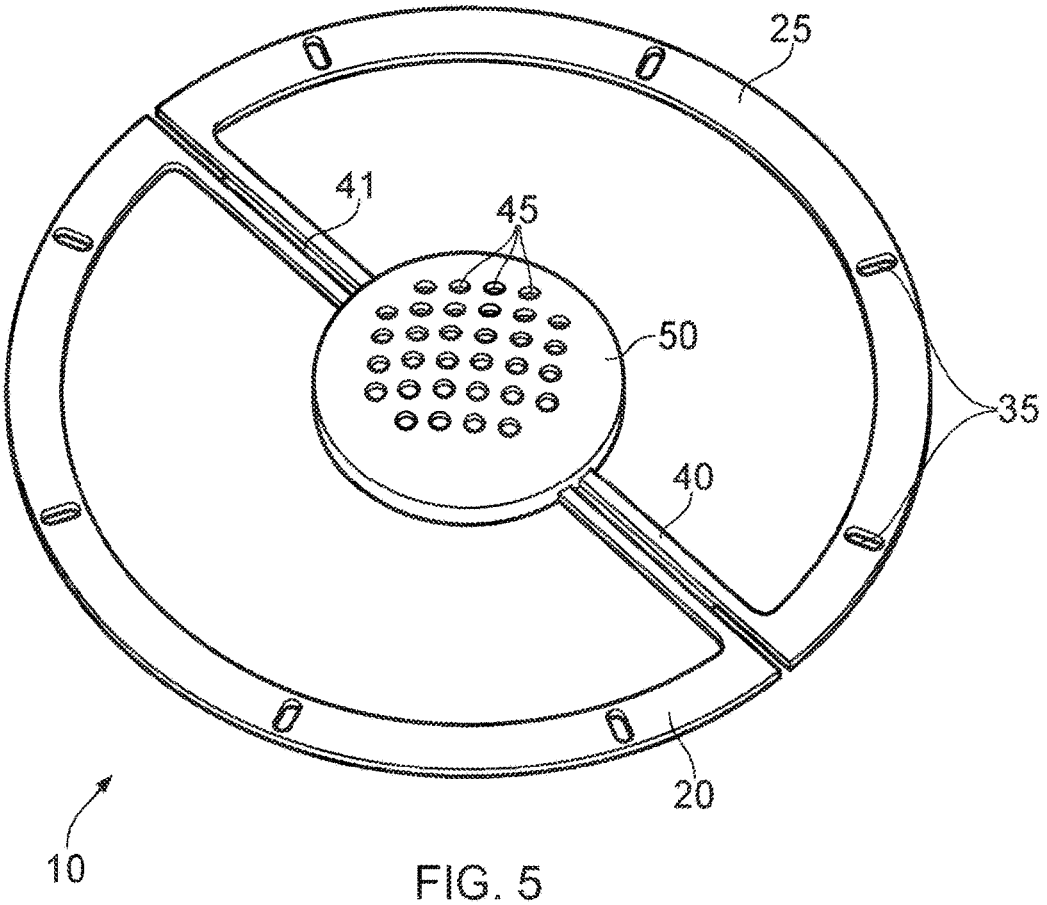

FIG. 4 is a perspective view from the front of a sound capture apparatus according to one arrangement. FIG. 5 is a perspective view from the back of the sound capture apparatus according FIG. 4; and FIG. 6 is a transverse cutaway along the line A-A shown in FIG. 4.

Figure 6:
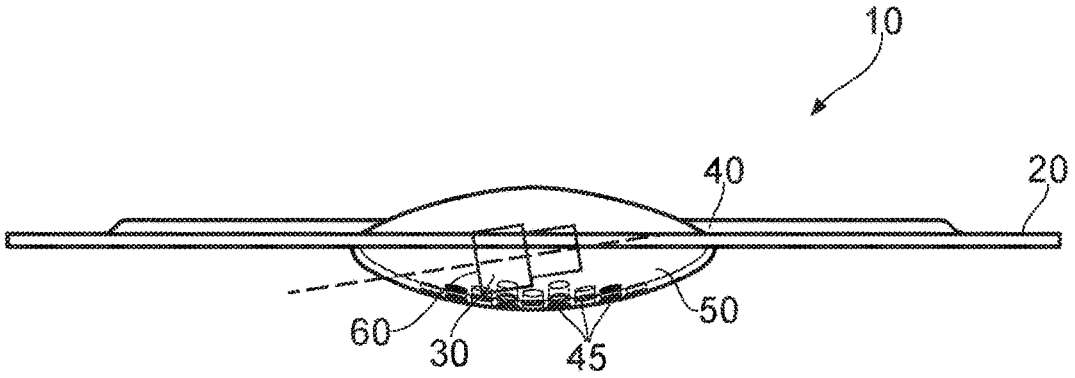

The sound capture apparatus 10 shown in FIGS. 4 to 6 comprises a microphone support 20 and a microphone 30 mounted on the support.

The support of the arrangement shown in FIGS. 4 to 6 comprises a substantially annular member 25. It will be appreciated that the diameter of the annular member 25 may be selected in dependence upon the diameter of a loudspeaker diaphragm. The annular member shown includes a plurality of slots 35. Those slots 35 are provided such that mounting fasteners (not shown) can be used to affix the apparatus 10 in place on a loudspeaker. The support 20 also comprises a crossbar 40 which spans the annular member.

The crossbar 40 of the support 20 further comprises a domed diffuser element 50. In the arrangement shown, the diffuser element is integrally formed with the crossbar 40. The diffuser element 50 is located on the support 20 such that, when the apparatus 10 is in position on a loudspeaker, a domed part of the diffuser projects into or onto the volume surrounded by a loudspeaker diaphragm, and is substantially concentric with the loudspeaker cone. The microphone 30 of the arrangement shown is located within the diffuser element 50.

The diffuser element shown includes a plurality of openings 45. As seen in FIG. 6 they are an array of circular holes. The openings are provided in a surface of the diffuser element 50 which faces the loudspeaker cone. Those openings 45 allow pressure waves caused by movement of the cone to reach the microphone 30 mounted behind the surface of the diffuser element which faces the loudspeaker cone. In the arrangement shown, the microphone collection face is mounted at an angle to the axis of the loudspeaker cone, rather than along that axis. Arranging the microphone in such a manner can help to ensure that the pressure waves detected by the microphone comprise those representative of a rounded sound, rather than simply high frequency treble sound. More specifically, the microphone capsule used here is a dynamic microphone capsule, which is well able to stand the high intensity of sound at this region. However in other situations other microphone types may be usable. The microphone has a cardioid pick up pattern and is mounted in the diffuser with its forward axis directed at about 5° angle to the front plane i.e. at about 85° angle to the device axis and speaker axis. In practice this means that its strongest response is directed to a region part-way out along the radius of the speaker, where a favourable frequency blend is achieved with the involvement of the diffuser. Wires (not shown) to and from the microphone 30 can be routed along crossbar 40 to, for example, a sound desk. Grooves 41 to accommodate such wires are shown in FIG. 5.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the general teachings herein, or from the invention as defined by the appended claims and their equivalents.

The invention claimed is:

1. A sound capture apparatus, for capturing sound produced by an audio device comprising a sound source and a loudspeaker having a conical diaphragm, the sound capture apparatus comprising:

a support adapted to be coupled at a front of said loudspeaker;

a microphone mounted on said support and located within a conical volume surrounded by said loudspeaker diaphragm when the support is coupled to said loudspeaker; and a beam diffuser mounted on said support and located within or at a front of said conical volume surrounded by the loudspeaker diaphragm and substantially concentric therewith when the support is coupled to said loudspeaker, said beam diffuser comprising a diffuser element that blocks beaming of treble frequencies from a center of the loudspeaker.

2. The sound capture apparatus according to claim 1, wherein said diffuser element of the beam diffuser is convex towards the loudspeaker.

3. The sound capture apparatus according to claim 1, wherein said diffuser element of the beam diffuser is circular in outline.

4. The sound capture apparatus according to claim 1, wherein said diffuser element of the beam diffuser has an array of openings.

5. The sound capture apparatus according to claim 1, wherein the microphone is mounted at or adjacent the beam diffuser.

6. The sound capture apparatus according to claim 1, wherein said microphone is mounted behind said diffuser element of the beam diffuser.

7. The sound capture apparatus according to claim 1, wherein the beam diffuser forms a housing and the microphone is housed within the housing.

8. The sound capture apparatus according to claim 1, wherein both the microphone and the beam diffuser are arranged on the support to lie substantially within said conical volume surrounded by the loudspeaker diaphragm.

9. The sound capture apparatus according to claim 1, wherein the microphone is a dynamic microphone.

10. The sound capture apparatus according to claim 1, wherein the microphone has a directional sensitivity pattern, having a pattern axis and is mounted such that when the support is coupled to said loudspeaker, the pattern axis is inclined away from the speaker axis by an angle from 45° to 90°.

11. The sound capture apparatus according to claim 1, wherein the support comprises a crossbar that spans a diameter of the loudspeaker.

12. A sound capture apparatus for capturing sound produced by a loudspeaker having a conical diaphragm and an annular periphery, the sound capture apparatus comprising:

a support adapted to be coupled at the front of said loudspeaker and comprising an annular member that fixes against or around an annular periphery thereof and a span element that extends radially inward from the annular member, the span element being a crossbar that spans a diameter of the loudspeaker or an arm extending radially inward across the front of the loudspeaker from an edge thereof;

a beam diffuser mounted on said support to be substantially concentric with the loudspeaker, the beam diffuser comprising an inner diffuser element which is convex towards the loudspeaker and has an array of openings that block beaming of treble frequencies from a center of the loudspeaker, and an outer element which forms a beam diffuser housing with the inner diffuser element; and a microphone mounted in the beam diffuser housing and located within a conical volume surrounded by said loudspeaker diaphragm when said support is coupled at the front thereof.

13. The sound capture apparatus according to claim 1, wherein the annular member of the support has a plurality of holes for the passage of fasteners used to mount the loudspeaker on a board.

14. The sound capture apparatus according to claim 1, wherein said microphone is adjustably mountable on said support.

15. A method of capturing sound produced by an audio device comprising a sound source and a loudspeaker, said method comprising coupling the sound capture apparatus according to claim 1 to said loudspeaker and capturing the sound using the microphone thereof, wherein said support is coupled at the front of the loudspeaker with the microphone being located inside the conical volume surrounded by the loudspeaker diaphragm, the beam diffuser being mounted on the support and the microphone being mounted in a housing constituted by the beam diffuser.

16. The sound capture apparatus according to claim 1 coupled to the loudspeaker by said support being coupled at the front of the loudspeaker with the microphone being located inside the conical volume surrounded by the loudspeaker diaphragm, the beam diffuser being mounted on the support and the microphone being mounted in a housing constituted by the beam diffuser.

17. The sound capture apparatus according to claim 1, wherein said diffuser element of the beam diffuser is a dome-shaped element convex towards the loudspeaker.

18. The sound capture apparatus according to claim 1, wherein the microphone has a directional sensitivity pattern in a cardioid pattern, having a pattern axis and is mounted such that when the support is coupled to said loudspeaker, the pattern axis is inclined away from the speaker axis by an angle from 70° to 88°.

19. The sound capture apparatus according to claim 1, wherein the support comprises an arm extending radially inward across the front of the loudspeaker from an edge thereof.

20. A sound capture apparatus for capturing sound produced by a loudspeaker having a conical diaphragm and an annular periphery, the sound capture apparatus comprising:

a support adapted to be coupled at a front of said loudspeaker and comprising an annular member or a segment of an annular member that fixes against or around the annular periphery thereof and a span element that extends radially inward from the annular member or segment, the span element being a crossbar that spans a diameter of the loudspeaker or an arm that reaches out across the front of the loudspeaker from an edge thereof;

a circular beam diffuser mounted on said support to be substantially concentric with the loudspeaker, the beam diffuser comprising a circular inner diffuser element that blocks beaming of treble frequencies from a center of the loudspeaker, and an outer element which forms a beam diffuser housing with the inner diffuser element; and a microphone mounted in said beam diffuser housing and located within a conical volume surrounded by said loudspeaker diaphragm when said support is coupled at the front thereof, the microphone having a directional sensitivity pattern having a pattern axis and being mounted in said beam diffuser housing such that when the support is coupled to said loudspeaker, the pattern axis is inclined away from the speaker axis by an angle from 45° to 90°.

* * * * *